United States Patent [19]

Paras

[11] Patent Number: 4,753,186

[45] Date of Patent: Jun. 28, 1988

[54] INFLATABLE SAIL FOR SAILING CRAFT

[76] Inventor: Ricardo S. Paras, 4488 Caminito Pedernal, San Diego, Calif. 92117

[21] Appl. No.: 943,450

[22] Filed: Dec. 19, 1986

[51] Int. Cl.[4] ..... B63H 9/06

[52] U.S. Cl. ..... 114/103

[58] Field of Search ..... 114/39.1, 39.2, 102, 114/103, 90

[56] References Cited

FOREIGN PATENT DOCUMENTS

| | | | |
|---|---|---|---|
| 3402053 | 8/1985 | Fed. Rep. of Germany | 114/90 |
| 2518956 | 7/1983 | France | 114/103 |
| 2541230 | 8/1984 | France | 114/103 |

*Primary Examiner*—Sherman D. Basinger

*Attorney, Agent, or Firm*—Frank D. Gilliam

[57] ABSTRACT

An improved sail for sailboards, small sailboats or the like having an efficient airfoil horizontal cross-section. The sail is formed from a sail panel which is wrapped around the mast and extends co-extensively aft away from the mast. An inflatable bag having a sleeve along one side is positioned within the sail panels with the sleeve over the mast. The sleeve is a narrow panel which wraps around the mast inside the sail and has edges substantially parallel to the mast which extend aft along the inside of the sail. The forward edge of the inflatable bag extends between the sleeve panel edges and is secured thereto such that the forward edge of the bag is pressed firmly against the mast when the bag is inflated. This arrangement prevents concave regions from forming immediately behind the mast when the sail is in use, which adversely affect sail performance. A rotatable tube is provided over the upper mast end which supports either a fixed or vertically pivotable streamlined shaped strut which extends aft between the upper edges of the sail panel. The upper aft corner of the sail is secured to the aft end of the strut, which maintains the streamlined airfoil shape of the upper sail area. Additionally, the bag may be held in place by suitable cords and straps extending between the bag corners and the sail.

18 Claims, 2 Drawing Sheets

INFLATABLE SAIL FOR SAILING CRAFT

BACKGROUND OF THE INVENTION

Sailing craft of one sort or another have been used for movement across the seas throughout recorded history. For hundreds of years, all great navies and merchant fleets of the world consisted of sailing vessels. By the early 1900's, however, steamships had almost completely replaced sailing vessels for military and commercial purposes. The development of sailing as a sport began when sailing ships declined in commercial importance.

Most sport sailboats today are Marconi-rigged, with triangular sails having a vertical edge or luff along a mast and a lower edge or foot secured to a boom. The mainsail is fastened to the back of the mainmast. Smaller sailboats, such as catboats, may have only the single mainsail. Other, larger craft may have a jib extending forwardly of the mast, as in the case of a sloop, or may have additional masts, as with yawls, ketches or schooners.

Recently, a great deal of interest has developed in sailboards (also called "windsurfers") wherein a single mast is mounted on a surfboard by means of a flexible universal joint, with a single sail having a forward edge lying along the mast. In sailing a sailboard, the person stands on the board next to the sail, holding onto an oval boom (called a "wishbone") surrounding the mast and sail. The sailboard is controlled by a combination of body movement along the board, body lean and sail positioning.

With small sailboats, the sail is an approximate right triangle, with the lower edge substantially perpendicular to the mast and parallel to the boat deck. With sailboards, the lower sail edge generally angles roughly 45° to mast and board. With these small craft, it is important that the single sail provide the maximum aerodynamic effect to provide optimum efficiency and speed. The design of sails, masts, rigging, etc. has been the subject of intense development and innovation for hundreds of years. Many attempts have been made to improve the arrangement and shape of the sail which has always been a single thin sheet of woven material.

From time to time, depending upon wind condition, sailboards and small sailboats may capsize. Generally it is possible for the sailor alone to right such small craft. However, if the sail goes below the water surface, or conditions are poor, the weight of the wet sail and any water over it may make righting the boat or board very difficult or impossible.

From its obscure beginnings in the late sixties, sailboards have become the fastest sailing vessels in the market today. Recorded sailboard speeds have made a dramatic increase from the top speed of 19.1 knots in 1977 to over 38 knots in 1986. The early gains in speed can be attributed to smaller and lighter hulls which were made possible by the extensive use of advanced materials such as graphite, Kevlar, the carbon with epoxy resin. More recent speed improvements, however, were provided by better sail designs.

Sailboard sails have several especial design features not normally associated with conventional sails. As a basic requirement, these sails have to be light enough to able to lifted out of the water by one individual without any mechanical devices such as winches or blocks. They need to be able to withstand not only high wind forces but also hydrostatic loads. Furthermore, these sails have to be able to sustain dynamic wave loads should they be used under surf conditions.

The basic form of sailboard sails have evolved from catamaran main sails. Early sailboard sails were triangular in shape with few or no battens. Today, practically all high performance sails have full battens. The so called RAF (Rotating Asymmetrical Foils), Camber Induced and Double Luff sails are typical examples. The differences between these sails is simply in the method by which they try to control the shape of the sail's leading edge.

Traditional single sheet sails provide a very high lift coefficient—higher than wingsails (like airplane wings). However, in high-speed, high-wind conditions such as often encountered by sailboards, they create a much higher drag which, in turn, inhibits greater speed. Dramatic improvements in speed can only be achieved by reducing this drag. Wingsails offer a viable solution to this problem.

Rigid wingsails have been tried on catamarans and sailboards before but they have not been very successful. Their internal structure as well as their double panel construction makes them too heavy particularly for sailboards. Their built-in rigidity does not allow them to twist and depower when a sudden gust or change in wind direction occurs, making them hard to control. They are also extremely difficult to transport since they cannot be rolled or folded. Furthermore, they have to be symmetrical in cross-section so they can perform well in either tack. Such a section is less efficient than an asymmetrical one.

By using inflatable sails, most of the disadvantages of rigid wingsails can be minimized or eliminated while its high lift-to-drag ratio can be maintained or even surpassed. An inflatable sail's unique ability to vary its camber and to assume an asymmetrical shape makes this possible.

Inflatable sails are disclosed by Cochran in U.S. Pat. No. 3,298,346 and Birchill in U.S. Pat. No. 3,391,668. In each of these, the sail itself is made up of two panels which are sealed to permit inflation. Making the sail itself airtight is very difficult, requiring very high strength-to-weight materials and requiring bonding and sealing methods different from the conventional sewing of sail panels together. Normal sailcloth is not airtight and normal plastic air impervious materials do not have sufficient strength for use as sails. Inflated sails of such normal plastic materials would be likely to leak and distort.

Cochran requires a number of transverse webs within the inflated sail to maintain sail shape. Although the webs tend to resist changes in sail shape in response to changes in wind direction and velocity the sail panels between the webs will assume a ripple-like configuration in the vertical direction. When the sail is raked forward or aft as is necessary in sailboards to control direction, the ripple-like configuration changes the sail's horizontal cross-section to a less effective one. This has a detrimental effect on performance.

Birchill inflates portions of the sail, a vertical area near the mast providing a bulge between mast and the flat balance of the sail. The sail is inflated by a pair of air scoops at the top of the sail, facing forward. These air scoops would simply fill up with water when used with sailboards, thus making it impossible to raise the sail.

Penduff in French Pat. No. 2,518,956 discloses a sail having two panels extending aft from an airfoil leading edge-shaped mast. A narrow vertical inflated bag is positioned well behind the mast. Battens are provided in both sail panels to control sail shape. This a a heavy and cumbersome arrangement, ill suited to sailboards which use round masts and require lightweight sails to permit righting by one person. Without the battens concave areas would certainly form between the mast and the inflated bag, on the windward side of the sail, resulting in a very poor airfoil shape.

Thus, there is a continuing need for improved sails that combine low weight and simplicity with the high lift-to-drag ratios typical of wingsails without their inherent weight problems.

SUMMARY OF THE INVENTION

The above-noted problems, and others, are overcome by the improved sail of this invention which includes an inflatable bag adjacent to the mast within a two-panel sail. The sail itself is formed from a sail panel which wraps around the mast and extends co-extensively aft to the aft end of the boom. An inflatable bag having a sleeve along one side is positioned within the sail with the sleeve over the mast. The sleeve is a narrow panel which is attached to the inflatable bag in manner permitting the forward side of the bag to be pressurized against the mast when the bag is inflated. This pressure contact prevents significant concave regions from forming just behind the mast which would happen if the inflatable bag were spaced some distance from the mast.

A rotatable tube which is provided over the upper end of the mast supports either a fixed or vertically pivotable streamlined strut which extends aft between the sail panels.

Supporting cords and straps as desired are connected between corners of the bag and sail to maintain the desired relationship. An inflation/deflation means is provided for the inflatable bag, and a larger valve may be provided for more rapid deflation of the bag.

When the bag is inflated, the sail has an airfoil cross-section when viewed in a chordwise direction. The chord and camber of the airfoil depends upon the degree of bag inflation selected, the camber being greater with greater inflation pressure. As discussed in detail below, the camber of the sail airfoil changes automatically from a shape efficient in light winds (fat, high lift) to one more effective in heavy winds (thinner, lower lift) as wind pressure increases. Even if all of the pressurizing gas should leak out during use, the sail could still perform as conventional single sheet sails. In high-performance conditions, such as racing, helium may be used as all or part of the pressurizing gas to reduce weight. Also, if the craft should capsize, the sail will float and be easier to lift.

BRIEF DESCRIPTION OF THE DRAWING

Details of the invention, and of certain preferred embodiments thereof, will be further understood upon reference to the drawing, wherein.

DETAILED DESCRIPTION OF THE INVENTION

Figure 1:
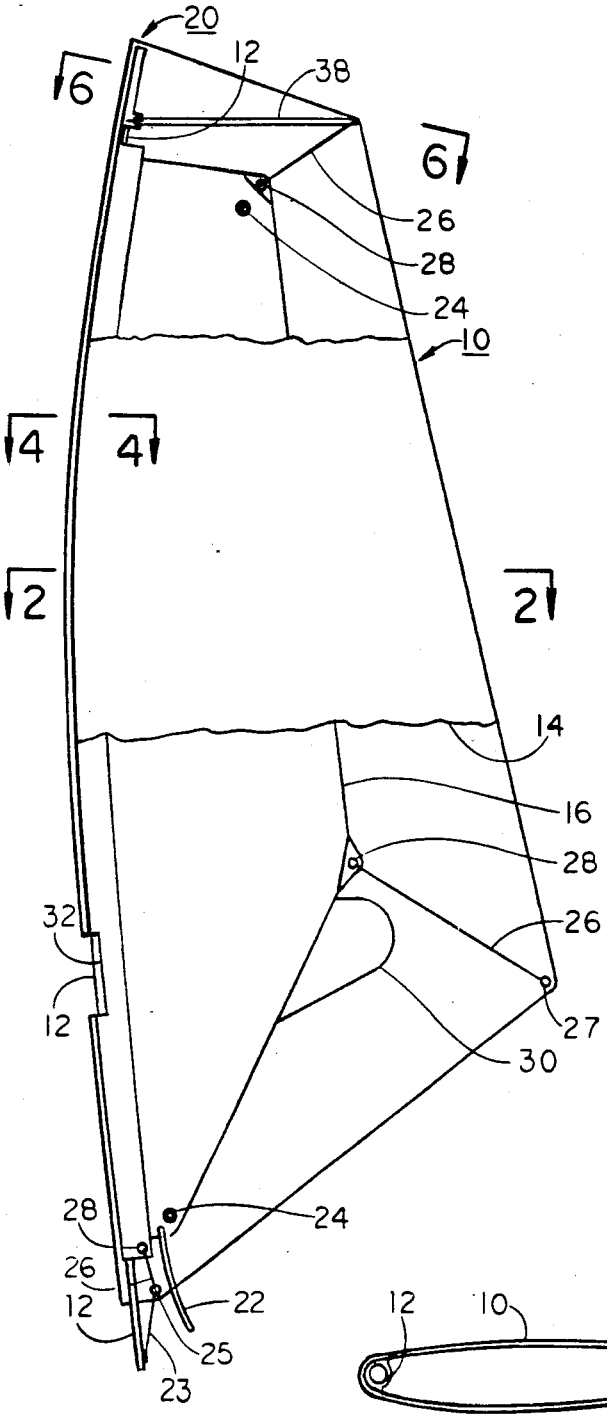
FIG. 1 is an elevation view of my sailboard sail.

Referring now to FIG. 1, there is seen a sailboard sail 10 adapted to being slid down over a sailboard mast 12 to the position shown. Sail 10 can be used with any conventional sailboard or any other sailing vessel using a sail which fits over the mast. Sail 10 comprises a sail panel which wraps around the forward edge of mast 12 and extends aft to form a co-extensive double panel sail. As seen in FIG. 1, the near panel 14 is cut-away at the top and bottom to permit the internal components to be seen.

The lower part of sail 10 is attached to mast 12 and boom (not shown) in a conventional manner. Downhaul line 23 secures grommet 25 to mast base while outhaul line (not shown) secures grommet 27 to boom.

Figure 2:
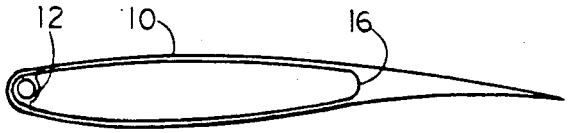
FIG. 2 is in a horizontal section view, taken on line 2—2 in FIG. 1.

An inflatable bag 16 (as best seen in FIGS. 1 and 2) is maintained against mast 12 within sail 10. As seen in detail in FIG. 3, when deflated the bag assembly consists of an inflatable bag 16 and a sleeve 18. Sleeve 18 extends over bag 16 and is secured thereto along the sleeve edges 19 in any suitable manner, such as sewing, thermal bonding, adhesive bonding or a combination thereof.

The bag 16 and sail 10 are slipped down over mast 12 to the position shown in FIG. 1, a strut assembly 20 (as described in detail below) is installed at the top of mast 12, boom is secured, lower part of sail 10 is secured, bag 16 is inflated through an inflation/deflation tube 22 and the sailboard sail is ready for use. For more rapid deflation at the end of use, one or more large deflation valves 24 may be provided. The bag may be inflated by any suitable means, such as a hand pump, gases from a pressurized container, etc.

Optimum results are obtained where the bag 16 extends from the leading edge of the sail 10 to within three-quarter chord distance towards the sail's trailing edge. This locates the point of maximum camber about 25 to 45% chord from the forward edge of the sail when the sail is under load which I have found produces best results.

Bag 16 is maintained in the desired position within sail 10, especially when deflated, by a suitable number of cords 26 and strap 44 running from grommets 28 along the corners of bag 16 and sleeve 18 to appropriate points on sail 10. For best results, at least four such connections should be used, one at each end of sleeve 18, one at the upper aft corner and one at the lower aft corner of the bag. With this arrangement, bag 16 can be rolled or folded together with sail 10.

A transparent window panel 30 is provided in sail 10 (and in bag 16 if it is not transparent) to allow the sailboard sailor to see through the sail while sailing. A cutout 32 is provided in the forward edge of sail 10 and sleeve 18 to permit attachment of a conventional sailboard boom (not shown).

Figure 4:
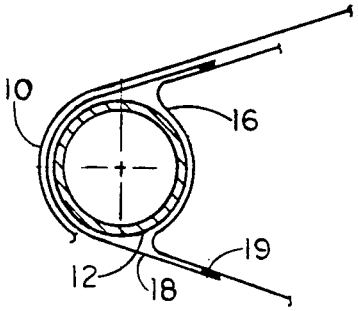
FIG. 4 is a detail section view taken on line 4—4 in FIG. 1.
Figure 3:
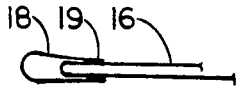
FIG. 3 is a detail section view as in FIG. 2, of the forward bag portion prior to installation on a mast.

As seen in FIGS. 3 and 4, sleeve panel 18 has an approximate "U" shaped and overlaps bag 16 significantly and is secured to the bag along the panel edges. This permits the sleeve to accommodate masts of different diameters, but more importantly, allows the front edge of bag 16 to be pressed tightly against mast 12 while wrapping partially around the mast. This prevents depressions or concavities from forming just behind the mast on the windward side of sail.

Figure 6:
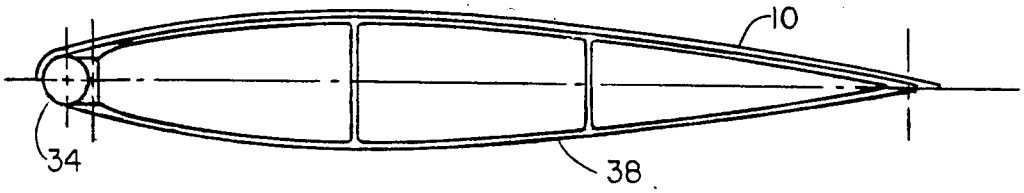
FIG. 6 is a detail view of the strut assembly, taken on line 6—6 in FIG. 1.
Figure 5:
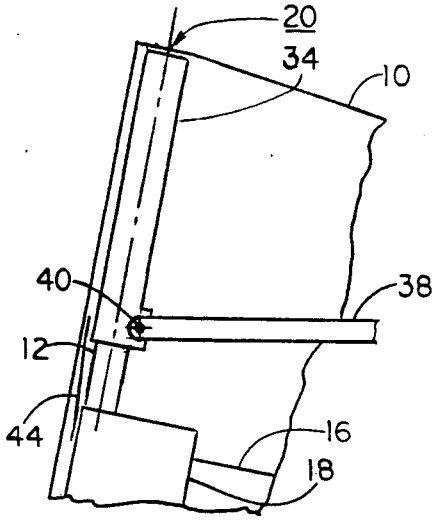
FIG. 5 is a detail view, partially cut-away, of the tube at the top of the mast in FIG. 1.

The upper forward section of sail 10 supports strut assembly 20 which fits over the upper end of mast 12, as shown in detail in FIGS. 5 and 6. Tube 34 fits over mast 12 and is attached to sail 10. A streamlined strut 38 is pivotally mounted at 40 for rotation about an axis substantially perpendicular to the mast. Strut 38 extends to the upper corner of the panels forming sail 10. The upper aft corner of sail 10 may be fastened to the aft end of strut 38. Strut 38 serves three purposes. Firstly, strut 38 makes it possible to set more sail area at the top of the sail without using full battens. This provides for a more efficient sail shape and minimizes boom size and weight. Secondly, the streamlined shape of the strut 38 insures that the top portion of the sail remains aerodynamic, since without the strut the inflatable bag 36 would tend to compress more at the the top than along the main body of the sail because of the generally higher stresses developed near the top of the sail. Finally, the pivoting feature of strut 38 compensates for any stretch in the sail material, keeping the top edge of sail 10 taut after long and repeated use.

Figure 7:
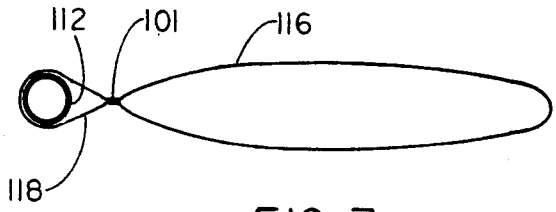
FIG. 7 is a schematic horizontal section view similar to FIG. 2 showing an alternate embodiment of my inflatable bag and mast attachment means.

FIG. 7 illustrates certain modifications to my inflatable bag which may be desirable under certain circumstances. Here, only bag 116 and mast 112 are shown in schematic horizontal section, in a manner similar to FIG. 2. Here, the bag is stitched, adhesively bonded or otherwise fastened together along a selected line 101. The portion forward of line 101 functions as a mast surrounding sleeve 118 corresponding to sleeve 18 in FIG. 4. This attachment means may also be formed by providing a sleeve 118 in the form of a tubular sleeve which is secured to the forward edge of a bag 116 by sewing, adhesive bonding or the like. Of course, the concave region nea line 101 will often be undesirable, so that this variation will be preferred only in special circumstances.

Figure 9:
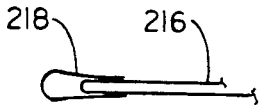
FIG. 9 is a section view taken on line 9—9 in FIG. 8.
Figure 8:
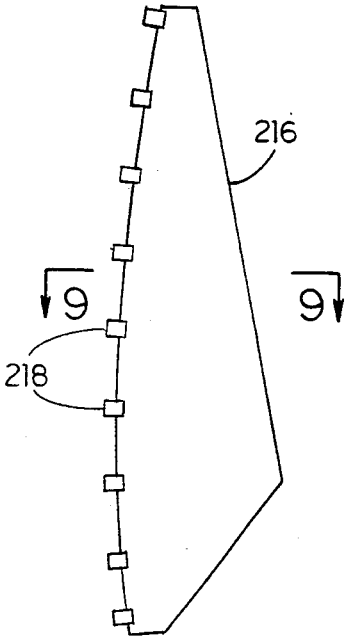
FIG. 8 is a side elevation view of another alternative embodiment of my inflatable bag and mast attachment means.

FIGS. 8 and 9 illustrate an alternative means for securing my inflatable bag to a mast. Here, bag 216 has a plurality of spaced straps 218 along the front edge of bag 216. Preferably, straps 218 are secured to bag 216 at substantially uniform locations back from the forward edge of bag 216 as shown in FIG. 9 to provide the wraparound effect shown in FIG. 4. While the full sleeve 18 shown in FIGS. 3 and 4 is ordinarily preferred since it more smoothly and uniformly supports the inflatable bag, the strap arrangement will have advantages in certain circumstances.

Figure 10:
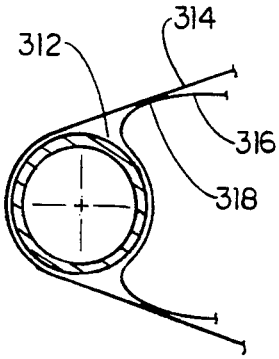
FIG. 10 is a schematic horizontal section view similar to FIG. 4 showing an alternate embodiment of my sail.

FIG. 10 illustrates a further embodiment of my sail generally similar to FIG. 4. Here, inflatable bag 316 is bonded directly to sail panel 314 at seam 318. Mast 312 fits between sail panel 314 and bag 316. This design eliminates the need for a separate mast attachment means for the inflatable bag and the cord and strap means of securing the forward ends of the inflatable bag to the sail panel.

Figure 11:
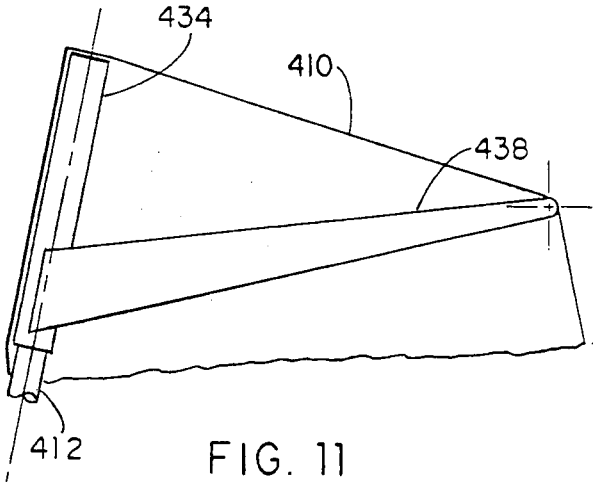
FIG. 11 is a detail view generally similar to FIG. 5 showing an alternate embodiment of my pivotable streamlined strut.

FIG. 11 illustrate an alternative to the pivotal streamlind strut. A streamlined strut 438 is fixedly attached to a tube 434 by welding, joining, fastening or any other attachment means. The tube 434 rotatably fits over the mast 412 while a strut 438 supports the upper aft corner of the sail 410. This fixed strut arrangement is generally more reliable, although it is heavier than the pivotable strut embodiment.

The sail of this invention provides a number of features not found in commercial sailboard sails or sails for other sailing vessels. This sail assembly provides a very "clean" leading edge without mast interference. The aerodynamic shape provides lift-to-drag ratios available only in wingsails without the weight problems and mechanical complexity of such sails while offering the ability to change camber by varying bag pressure. The extra flotation that is inherent with this sail assembly not only makes it easier to lift out of the water but also provides added safety for the sailor.

While certain preferred arrangements, proportions and materials were detailed in the above description of preferred embodiments, these may be varied, where suitable, with similar results. For example, the configuration of the bag and sail may be varied for use with sailboats of different designs.

Other variations, ramifications and applications of this invention will occur to those skilled in the art upon reading this disclosure. Those are intended to be included within the scope of this invention, as defined in the appended claims.

I claim:

1. An improved sail for use with sailing craft having a mast and boom comprising:

a sail panel wrapped around said mast and extending towards the trailing end of said boom forming a coextensive, double-panel sail;

an inflatable bag located within said sail; and at least one sleeve wrapped around said mast and attached to the forward portion of said bag.

2. The sail according to claim 1 further including:

a rotatable member adapted to rotate relative to the upper end of said mast;

a strut pivotally fastened to said rotatable member for rotation about an axis substantially perpendicular to said mast;

said strut extending between said panels to the upper aft corner to said sail; and means securing the aft end of said strut to the upper aft corner of said sail.

3. The sail according to claim 2 wherein said strut has a streamlined shape.

4. The sail according to claim 1 further including a strut assembly comprising a tube rotatably positioned over the upper end of said mast and a streamlined strut pivotally mounted on said tube for rotation about an axis substantially perpendicular to said mast, said strut extending to the upper aft corner of said sail.

5. The sail according to claim 1 further including:

a strut assembly comprising a strut fixedly attached to a tube which is rotatably positioned over the upper end of said mast.

6. The sail according to claim 1 further including at least one valve on said bag for rapidly releasing gas pressure from said bag and an inlet/outlet hose connected to the lower portion of said bag for filling and emptying said bag of gas.

7. The sail according to claim 1 wherein said sleeve comprises an approximately "U" shaped sleeve panel which overlaps the forward edge of said bag and is secured to said bag aft of said forward edge.

8. The sail according to claim 1 wherein said sleeve comprises a plurality of spaced approximately "U" shaped straps each of which overlaps the forward edge of said bag and is secured to said bag aft of said forward edge.

9. The sail according to claim 1 wherein said sleeve having a trailing edge secured along a line to the forward edge of said bag.

10. The sail according to claim 1 wherein said sleeve is formed by securing opposite sides of said bag together along a line substantially parallel to the forward edge of said bag.

11. The sail according to claim 1 wherein said sleeve attachment comprises a seam between said bag and said sail adjacent to said mast.

12. An improved sail for use with sailing craft having a mast and boom comprising:

a sail panel adapted to wrap around said mast and extend towards the trailing edge of said boom forming a co-extensive, double panel sail; and an inflatable bag located within said sail, said bag having a forward side lying against said mast and an attachment means adapted to maintain said forward side against said mast;

a strut assembly comprising a rotatable member adapted to rotate relative to the upper end of said mast and a strut pivotally mounted on said rotatable member for rotation about an axis substantially perpendicular to said mast, said strut extending to the upper aft corner of said sail.

13. The improvement according to claim 12 further including means for inflating and deflating said bag.

14. The improvement according to claim 12 wherein said attachment means comprises an approximately "U" shaped sleeve panel which overlaps the forward edge of said bag and is secured to said bag aft of said forward edge.

15. The improvement according to claim 12 wherein said attachment means comprises a plurality of spaced approximately "U" shaped straps each of which overlaps the forward edge of said bag and is secured to said bag aft of said forward edge.

16. The improvement according to claim 12 wherein said attachment means comprises a bonded seam between said bag and said sail adjacent to said mast.

17. The sail according to claim 1 wherein said sleeve secures said bag against said mast.

18. The sail according to claim 1 wherein the internal pressure of said inflatable bag when inflated forces the aft inside section of said sleeve against the trailing edge of said mast.

* * * * *